United States Patent [19]

Wood

[11] 4,064,645

[45] Dec. 27, 1977

[54] SACHET FOR THE ATTACHMENT OF STAMPS, TOKENS AND LIKE DEVICES TO CONTAINERS

[75] Inventor: William Wood, Naphill, England

[73] Assignees: Harrison & Sons (High Wycombe) Limited, High Wycombe; Green Shield Trading Stamp Company Limited, Edgware, both of England

[21] Appl. No.: 580,354

[22] Filed: May 23, 1975

[30] Foreign Application Priority Data

June 5, 1974 United Kingdom ..... 24948/74

[51] Int. Cl.[2] ..... G09F 1/10

[52] U.S. Cl. ..... 40/159

[58] Field of Search ..... 206/.82, .8, .81; 40/100, 158, 159, 307

[56] References Cited

U.S. PATENT DOCUMENTS

| | | | |
|---|---|---|---|
| 1,136,163 | 4/1915 | O'Brien | 40/159 |
| 1,943,022 | 1/1934 | Koster | 40/158 R |
| 2,041,170 | 5/1936 | Dorsey | 229/37 |
| 2,335,636 | 11/1943 | Bodie | 40/307 |
| 2,861,370 | 11/1958 | McArthur | 40/159 |
| 2,925,675 | 2/1960 | Lumpkin | 40/159 X |
| 3,155,234 | 11/1964 | Knoll et al. | 206/47 |
| 3,253,360 | 5/1966 | Spicer | 40/158 R |
| 3,522,673 | 8/1970 | Dudley | 40/158 R |
| 3,804,323 | 4/1974 | Bemel | 229/53 |

FOREIGN PATENT DOCUMENTS

| | | | |
|---|---|---|---|
| 2,033,777 | 4/1970 | France | 40/2.2 |
| 1,486,397 | 6/1970 | Germany | 40/312 |
| 996,615 | 6/1965 | United Kingdom | 40/135 |
| 1,251,649 | 12/1969 | United Kingdom | 40/159 |

*Primary Examiner*—Russell R. Kinsey
*Assistant Examiner*—Wenceslao J. Contreras
*Attorney, Agent, or Firm*—Young & Thompson

[57] ABSTRACT

A sachet is described for holding an article such as a stamp or token and for attachment to a container or package or other goods.

The sachet has a paper backing sheet coated on its back surface with a heat-activated adhesive. A facing sheet, which is preferably transparent is, secured to the backing sheet around its periphery to form an enclosed pocket for the article.

2 Claims, 2 Drawing Figures

SACHET FOR THE ATTACHMENT OF STAMPS, TOKENS AND LIKE DEVICES TO CONTAINERS

This invention relates to the attachment of stamps, tokens and like devices to containers, packages and other goods and to sachets for this purpose.

It is well-known for trade promotional purposes, to include in packaged goods, articles such as stamps or tokens or other devices e.g. badges or small toys. These may be for collection by the user of the goods either for their intrinsic value or to be exchanged for something else. In many forms of packages goods, such articles can be put within the package and for this purpose are commonly enclosed within a small envelope or bag of paper, plastics or other sheet material. It is also possible, in some circumstances, to provide a token or the like as part of a paper or plastics packaging material. However there are many types of packaged foods, for example, canned foods, where it is not possible to include such a stamp, token or other device within the package. Although in certain cases, it is possible on such packages to make tokens as part of an external paper wrapping, often this is impossible or inconvenient.

Numerous sachets are known, particularly, for use by philatelists for displaying postage stamps. Such sachets generally comprise a backing sheet and a transparent facing sheet between which the stamp is inserted. The facing sheet is normally secured to the backing sheet only along one, two or three edges of the sachet, thereby permitting easy insertion and withdrawal of the stamp. The backing sheets of known sachets are sometimes coated with an impact adhesive so that they may be stuck on the pages of an album. It is not required that the bond provided by such impact adhesive is very strong, since it has only to support the weight of the sachet and stamp contents. Furthermore, it is desirable that the sachet can be removed from the page without any tearing to enable a layout of stamps to be changed. These philatelic-type sachets protect the stamps against accidental tearing or damage. However, they are chiefly concerned with providing an attractive display of the stamps without making direct adhesive bonds to the paper of the stamps, as with, for instance, stamp hinges. Examples of known sachets are described in the specification of British Pat. Nos. 1,251,649, U.S. Pat. No. 2,179,884 and Swiss Pat. No. 260,589 and 523,789.

According to one aspect of the present invention, a sachet for holding a stamp, token or like device and for attachment to a container or package or other goods comprises a backing sheet of paper having a heat-activated adhesive coating on a back surface thereof and a facing sheet secured around its periphery or around at least a major part of its periphery to said backing sheet on the front surface thereof. The facing sheet is conveniently of the same size as the backing sheet and may be secured for example by a band of adhesive along the peripheral edges of the facing sheet and backing sheet or by a crimping process. In another embodiment, the whole or part of surfaces of the facing and backing sheets to be secured together are coated with a latex based cold seal adhesive. In each case, the two sheets are secured together after the stamp, token or other device has been placed between them. Conveniently, the facing sheet is transparent or translucent. This form of sachet may be attached to a container such as for example a metal can by heating the heat-activated adhesive, e.g. with infra-red radiation and pressing the adhesive coated surface of the paper onto the container. As explained later, however, the sachet can readily be applied to a wide variety of containers, packages or other goods.

By having a paper backing sheet, the adhesive bond can readily be made sufficiently strong and the paper sufficiently weak that any attempt to remove the sachet results in tearing of the paper. Evidence of tampering is thus clearly visible; this gives a large measure of protection against removal of sachets from goods, for example, on display in shops. The corners of the sachet may be formed as radii instead of square to improve the adhesion at the corners and reduce the risk of pilferage.

It will be seen that with this construction of sachet, when the sachet is applied to a container or other goods, the sachet serves to protect the article within the sachet from contamination. It is readily possible for example to include within the sachet a gummed stamp, the sachet keeping the stamp clean and ready for use. By sealing the two sheets together around the whole or substantially the whole of the periphery, pilferage of the device within the sachet is impossible without tearing the sachet.

Preferably the facing sheet is a glassine or polyester film. "Glassine" is used in the paper making industry as the generic term for a bleached glazed paper made from wood pulp. A glassine film can readily be made resistant to tearing, thereby providing further security against pilfering. It is important that the film is sufficiently temperature resistant so that it is not damaged during heating of the heat-activated adhesive coating on the back surface of the backing sheet. The under surface of the glassine film facing the front surface of the backing sheet may be completely coated with a cold-seal adhesive to provide a barrier preventing ingress of moisture to the interior of the sachet.

The heat-activated adhesive can securely attach the sachet to the container or other goods. Preferably the whole surface area of the back surface of the backing sheet is coated with this heat-activated adhesive, to ensure that the sachet cannot be removed from a container or the like without destroying the sachet and leaving clear visible evidence of this. Such heat-activated adhesives can provide a very firm attachment such that the paper or like material forming the rear surface of the sachet will necessarily be torn in attempting to remove the sachet.

The sachet may readily be attached to any form of container having a surface such that the sachet can be pressed firmly into contact therewith. It may readily be applied for example to rigid packages such as flat or cylindrical cans or bottles or boxes but, more generally, can be applied to a very wide variety of packaged goods, e.g. plastics film or paper wrapped goods, blister packs, cardboard packs, cardboard boxes, goods in bags, plastics or metal tubes, shrink-wrapped goods, blow-moulded containers, etc. It may also readily be applied to a wide variety of unwrapped goods, e.g. hardware, textiles, etc.

In the following description, reference will be made to the accompanying drawings, in which.

Figure 1:
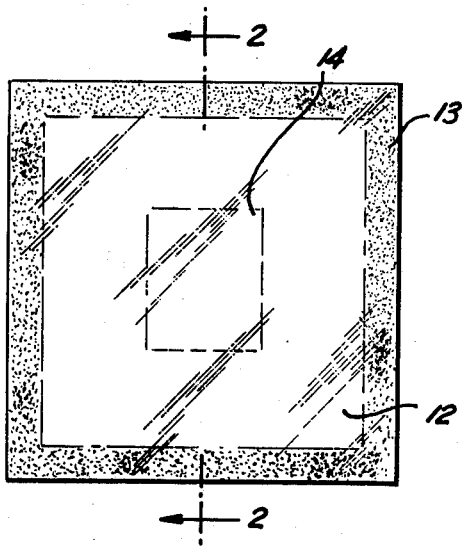
FIG. 1 is a plan view of a sachet.
Figure 2:
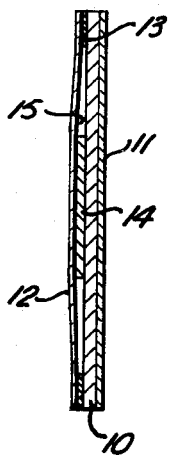
FIG. 2 is a sectional view with the thickness of the various layers exaggerated for clarity.

Referring to the drawings the sachet comprises a paper backing sheet 10 coated on one surface with a delayed action heat-activated adhesive 11. Such paper is commercially available from a number of firms. The adhesive is typically a combination of acrylic or maleic resin and a plasticiser, mixed at a temperature below the melting point of the plasticiser in a suitable dispersal medium, usually water. The front of the sachet is formed by a facing sheet 12 of transparent material, such as a copolymer coated cellulose film. The two sheets are of the same size and are secured together by a band of adhesive 13 around their periphery after a token 14 or other article has been placed between the sheets. The sachet thus formed is then applied to a container, e.g. a metal can or other package, by heating the heat-activated adhesive 11, for example with an infrared heater, and then pressing the sachet onto the surface of the container to which it is to be attached.

In a preferred embodiment, the sheet 12 is a glassine film. The under surface of the glassine film i.e. that on the inside of the sachet, is completely coated with a cold-seal adhesive 15. The front surface of the paper sheet 10, opposite to the surface coated with heat-activated adhesive 11, is also coated with the cold-seal adhesive, but only in a band around the periphery of the sheet 10. Thus, the glassine film adheres to the sheet 10 only along this peripheral band. An advantage of this arrangement is that accurate positioning of the glassine film on the sheet 10 during manufacture is not necessary to ensure that a suitable pocket is left between the sheet 10 and the film to accommodate an article, such as token 14. Further, it is often necessary to prevent ingress of damp to the interior of the sachet, for example when the sachet, or the container to which it is affixed, is in a damp environment, such as a deep-freeze store. The glassine film is rendered damp proof by the coating of cold-seal adhesive. It will be understood that it is important to keep the inside of a sachet dry when it holds a trading stamp which has a gum coating which becomes tacky when moistened. One advantage of using a glassine film for facing sheet 12 is that glassine film can more readily withstand the temperatures encountered during activating the heat-activated adhesive on the backing sheet 10 of the sachet.

It is convenient that the band of cold-seal adhesive around the periphery of sheet 10 is coloured to contrast with the rest of the front surface of sheet 10. This facilitates proper location of the stamps, token or other article on the sheet 10 inside the peripheral band of cold-seal adhesive.

Instead of only being coated with cold-seal adhesive in a peripheral band, the front surface of the paper backing sheet may be completely coated. Then, on pressing the facing and backing sheets together with a token or stamp etc. between the sheets, they adhere together over substantially the whole contact area surrounding the token or stamp.

The normal adhesive gum used on a trading stamp which may be enclosed in the sachet does not adhere to the cold-seal adhesive on the backing sheet. Thus, the token or stamp can be retrieved by the purchaser of the merchandise carrying the sachet by carefully tearing or cutting open the sachet.

It has been found that the heat-activated adhesive on the back of sheet 10 can successively bond the sachet to damp, or oily surfaces. Thus, the sachet is suitable for attachment to cans of oil, wine bottles and other containers of liquids whose exteriors may have been contaminated by spilling during filling. The heat activated adhesive strikes through such contaminants to provide a strong tamper-proof bond with the surface of the container. Also, traces of animal fat or vegetable oil do not prevent a satisfactory bond from being formed. It is important to ensure that the sachet is firmly bonded to the container or package to discourage pilfering. With heat-activated adhesive, the sachet cannot be removed without tearing either the paper sheet 10, or the surface of the container or package.

Other advantages are provided by using heat-activated adhesive on the sheet 10 of the sachet. The cost of such adhesive can be lower than other types, such as impact adhesive. The expense of the release cover papers, which are discarded as waste from impact adhesive coatings, is avoided. It may sometimes be required to insert a sachet of the present invention, inside a package of, for example, foodstuffs, without activating the heat activated adhesive coating. This is not possible with impact adhesive coated sachets, as particles of food would stick to the impact adhesive coating. Heat-activated adhesive tolerates deep freeze conditions indefinitely, when affixed to containers to be deep frozen. Heat-activated adhesive coated sachets can be stacked without becoming stuck together. Stacking is useful if the sachets are to be fed from a hopper in a machine for applying the sachets to containers or packages.

Another application of the sachet may be for containing samples of the contents of the merchandise package carrying the sachet, thereby enabling prospective purchasers to inspect the colour, texture or shape etc of the merchandise before deciding to buy. The sachet might instead contain an instruction leaflet.

I claim:

1. A sachet for holding a trade article and for attachment to an article of merchandise, comprising a paper backing sheet, a continuous transparent glassine facing sheet which is imperforate within its borders, a cold-seal adhesive coating completely covering a back surface of the facing sheet, a cold-seal adhesive coating on a front surface of the backing sheet at least completely around a peripheral band thereof, the cold-seal adhesive coatings sealing only when in contact with a corresponding coating, the facing and backing sheets being secured together by the coatings of cold-seal adhesive so as to form a completely enclosed pocket between the sheets, the transparent facing sheet being rendered impervious to moisture by the cold-seal adhesive coating on the back surface thereof, and a heat-activated adhesive coating on a back surface of the backing sheet for fastening the sachet to an article of merchandise.

2. A sachet as claimed in claim 1, wherein said coating of cold-seal adhesive on the front surface of the backing sheet extends only in said peripheral band of the backing sheet.

* * * * *